US010990030B2

(12) United States Patent
Matsumoto

(10) Patent No.: US 10,990,030 B2
(45) Date of Patent: Apr. 27, 2021

(54) SHADING CORRECTION SIGNAL GENERATION DEVICE, MULTIFUNCTION APPARATUS, AND SHADING CORRECTION SIGNAL GENERATION METHOD FOR GENERATING SHADING CORRECTION SIGNAL HAVING DESIRED LEVEL

(71) Applicant: SHARP KABUSHIKI KAISHA, Sakai (JP)

(72) Inventor: Kazutaka Matsumoto, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 16/841,027

(22) Filed: Apr. 6, 2020

(65) Prior Publication Data

US 2020/0379369 A1 Dec. 3, 2020

(30) Foreign Application Priority Data

May 28, 2019 (JP) ..... JP2019-099822

(51) Int. Cl.
*G03G 15/04* (2006.01)
*G03G 15/043* (2006.01)

(52) U.S. Cl.
CPC ... *G03G 15/0435* (2013.01); *G03G 15/04036* (2013.01); *G03G 2215/0404* (2013.01)

(58) Field of Classification Search
USPC ..... 399/51
See application file for complete search history.

(56) References Cited

U.S. PATENT DOCUMENTS 6,980,322 B1 * 12/2005 Hamada ..... G03G 15/326 358/1.7
9,699,352 B1 * 7/2017 Chen ..... G06K 15/1209
2010/0074651 A1 * 3/2010 Koga ..... G02B 26/128 399/151

FOREIGN PATENT DOCUMENTS

JP 2006-198894 A 8/2006

* cited by examiner

*Primary Examiner* — Q Grainger
(74) *Attorney, Agent, or Firm* — ScienBiziP, P.C.

(57) ABSTRACT

To provide a shading correction signal generation device including a correction amount setting signal generator that generates a correction amount setting signal, a modulator that modulates the correction amount setting signal by a predetermined modulation scheme and outputs the modulation signal, and a filter circuit that filters the modulation signal to generate a shading correction signal. During a transition period, the correction amount setting signal generator generates the correction amount setting signal in which a difference between a level at an end of a predetermined period and an average level during the transition period is larger than a difference between the level at the end of the predetermined period and a level at a start of a shading correction period.

16 Claims, 17 Drawing Sheets

SHADING CORRECTION SIGNAL GENERATION DEVICE, MULTIFUNCTION APPARATUS, AND SHADING CORRECTION SIGNAL GENERATION METHOD FOR GENERATING SHADING CORRECTION SIGNAL HAVING DESIRED LEVEL

BACKGROUND OF THE INVENTION

Field of the Invention

The present invention relates to a shading correction signal generation device for correcting a shading generated in an electrophotographic multifunction apparatus, an image forming device, and the like; a multifunction apparatus; and a shading correction signal generation method.

Description of the Background Art

In an electrophotographic multifunction apparatus or an image forming device, the shading may possibly be generated in laser light due to an optical system until the laser light reaches a photosensitive drum, and a shading correction is performed to correct this problem. As a result, laser light intensity is uniform along a main scanning direction of the photosensitive drum to improve a quality of a formed image.

In a case of using a configuration of generating a shading correction signal by using a smoothing circuit based on a correction amount setting signal to generate a smooth shading correction signal based on the correction amount setting signal changing stepwise, conventionally, there is a problem as follows. That is, in a case where the required laser light intensity is different between a non-image area and an image area, even if a level of the correction amount setting signal to correct the laser light intensity is changed when the laser light advances from the non-image area to the image area. there occurs a delay by the smoothing circuit. This example is illustrated in FIG. 1. A predetermined period and a transition period are periods corresponding to the non-image area, and a shading correction period is a period corresponding to the image area. During the predetermined period, it is necessary to maintain the laser light intensity lower than during the shading correction period for a predetermined purpose. If a level of the correction amount setting signal A during the predetermined period is maintained until the transition period ends and the level of the correction amount setting signal A is increased when the shading correction period starts, as a result of the smoothing circuit, it takes a long period of time until a shading correction signal B reaches an originally required level. Therefore, it is not possible to correctly perform the shading correction in a portion where the image area starts.

In the invention disclosed in Japanese Unexamined Patent Application Publication No. 2006-198894 (Patent Document 1), as illustrated in FIG. 2, from the start of the transition period, the level of the correction amount setting signal A is set equal to the level obtained at the start of the shading correction period corresponding to the image area to resolve the problem.

However, the optical scanning device disclosed in Patent Document 1 has the following problem. That is, as illustrated in FIG. 3, there is still a problem that even if the level of the correction amount setting signal A is set equal to the level obtained at the start of the shading correction period corresponding to the image area from the start of the transition period, when the transition period is short, the level of the shading correction signal does not sufficiently rise at the start of the shading correction period, and the normal shading correction cannot be performed.

In particular, even if the transition periods have the same length, when a level difference between light amount setting signals before and after the predetermined period is switched to the transition period is large, a level of an actual shading correction signal is significantly low for a level of an actually required shading correction signal.

Here, the case where the transition period cannot be sufficiently prepared includes the following cases, for example.

In a case of a small multifunction apparatus, a distance between a detector for BD detection and the photosensitive drum is short, and in such a case, a sufficient transition period cannot be prepared.

Further, in a case of printing on A3 wide paper, the transition period is short.

The case where the level difference between the light amount setting signals before and after the switching is large includes the following case, for example.

In some cases, the shading correction needs to he performed asymmetrically when viewed from a center position in a main scanning direction, and in such a case, the shading correction signal needs to be positively offset. Also in this case, the level difference between the shading correction signals before and after the switching is large. For example, such a necessity arises when uneven main body process sensitivity is also corrected by the shading correction signal.

In some cases, it is necessary to lower an overall level of the shading correction signal, but in such a case if no further processing is additionally applied, laser light for BD detection may be insufficient. To avoid this, the level of the shading correction signal is increased only in a BD area. Also in such a case, the level difference before and after the switching is large.

There are various types of laser drivers, and in particular, there is a laser driver in which a reference signal of the main scanning direction, a reference signal of a sub scanning direction, and a modulated image signal are input, and based on a signal obtained by modulating a signal having an amplitude determined by the reference signal of the main scanning direction and the reference signal of the sub scanning direction, with the modulated image signal, a laser emission source is turned ON/OFF. In the case of such a laser driver, the reference signal of the main scanning direction can be used as a shading correction signal. However, in the case of such a laser driver, if the reference signal of the main scanning direction is not set to zero volt during an APC period, the above-mentioned amplitude will not be a desired amplitude. Therefore, if such a laser driver is used, it is necessary that the reference signal of the main scanning direction is set to a signal of zero volt in the APC period, and is set to the shading correction signal in other periods. Therefore, the level difference before and after the switching is large.

In view of the above, it is an object of the present invention to provide a shading correction signal generation device by which it is possible to generate a shading correction signal having a desired level from a start of a shading correction period, even if a transition period between a predetermined period to the shading correction period is short, and a level difference of a shading correction signal required during the predetermined period and a shading correction signal required during the shading correction period is large, a multifunction apparatus thereof, and a shading correction signal generation method therefor.

SUMMARY OF THE INVENTION

The present invention provides a shading correction signal generation device for generating a shading correction signal to correct shading, the device including:

a correction amount setting signal generator that generates a correction amount setting signal, a modulator that modulates the correction amount setting signal by a predetermined modulation scheme and outputs the modulation signal, and a filter circuit that filters the modulation signal to generate the shading correction signal, in which the correction amount setting signal generator generates the correction amount setting signal in which a level of the shading correction signal is a level corresponding to a predetermined period, during the predetermined period, generates the correction amount setting signal in which the level of the shading correction signal changes to correct the shading, during a shading correction period starting after a transition period passes from the predetermined period, and generates the correction amount setting signal in which a difference between a level at an end of the predetermined period and an average level during the transition period is larger than a difference between the level at the end of the predetermined period and a level at a start of the shading correction period, during the transition period.

Further, the present invention provides a shading correction signal generation device for generating a shading correction signal to correct shading, the device including:

a correction amount setting signal generator that generates a correction amount setting signal, a subtractor that obtains an error signal, based on the correction amount setting signal and a feedback signal, a modulator that modulates the error signal by a predetermined modulation scheme and outputs the modulation signal, a filter circuit that filters the modulation signal to generate the shading correction signal, and a feedback device that obtains the feedback signal from the shading correction signal, in which the correction amount setting signal generator generates the correction amount setting signal in which a level of the shading correction signal is a level corresponding to a predetermined period, during the predetermined period, generates the correction amount setting signal in which the level of the shading correction signal changes to correct the shading, during a shading correction period starting after a transition period passes from the predetermined period, and generates the correction amount setting signal in which a difference between a level at an end of the predetermined period and an average level during the transition period is larger than a difference between the level at the end of the predetermined period and a level at a start of the shading correction period, during the transition period.

Further, the present invention provides a shading correction signal generation device for generating a shading correction signal to correct shading, the device including:

a correction amount setting signal generator that generates a correction amount setting signal, a modulator that modulates the correction amount setting signal by a predetermined modulation scheme and outputs the modulation signal, and a filter circuit that filters the modulation signal to generate a shading correction signal, in which the correction amount setting signal generator generates the correction amount setting signal in which a level of the shading correction signal is a level corresponding to a predetermined period, during the predetermined period, generates the correction amount setting signal in which the level of the shading correction signal changes to correct the shading, during a shading correction period starting after a transition period passes from the predetermined period, where the correction amount setting signal is capable of having a predetermined difference relative to a setting level for hold period from a start of the shading correction period, and generates the correction amount setting signal having the setting level for hold period, during a hold period from an unspecified middle point of the transition period to an end of the transition period.

Further, the present invention provides a light source drive system device including:

the above-described shading correction signal generation device, and a driver that generates a light source drive signal to drive a light source, based on at least the shading correction signal and an image signal Further, the present invention provides an image forming device including the above-described shading correction signal generation device.

Further, the present invention provides a multifunction apparatus including the above-described shading correction signal generation device.

According to the present invention, it is possible to generate a shading correction signal of a desired level from a start of a shading correction period even if a time from a switching timing to a start of a shading correction is short or a level difference before and after the switching is large.

DESCRIPTION OF THE PREFERRED EMBODIMENTS

Embodiments for carrying out the present invention will be described in detail with reference to the drawings below.

First Embodiment

Figure 4:
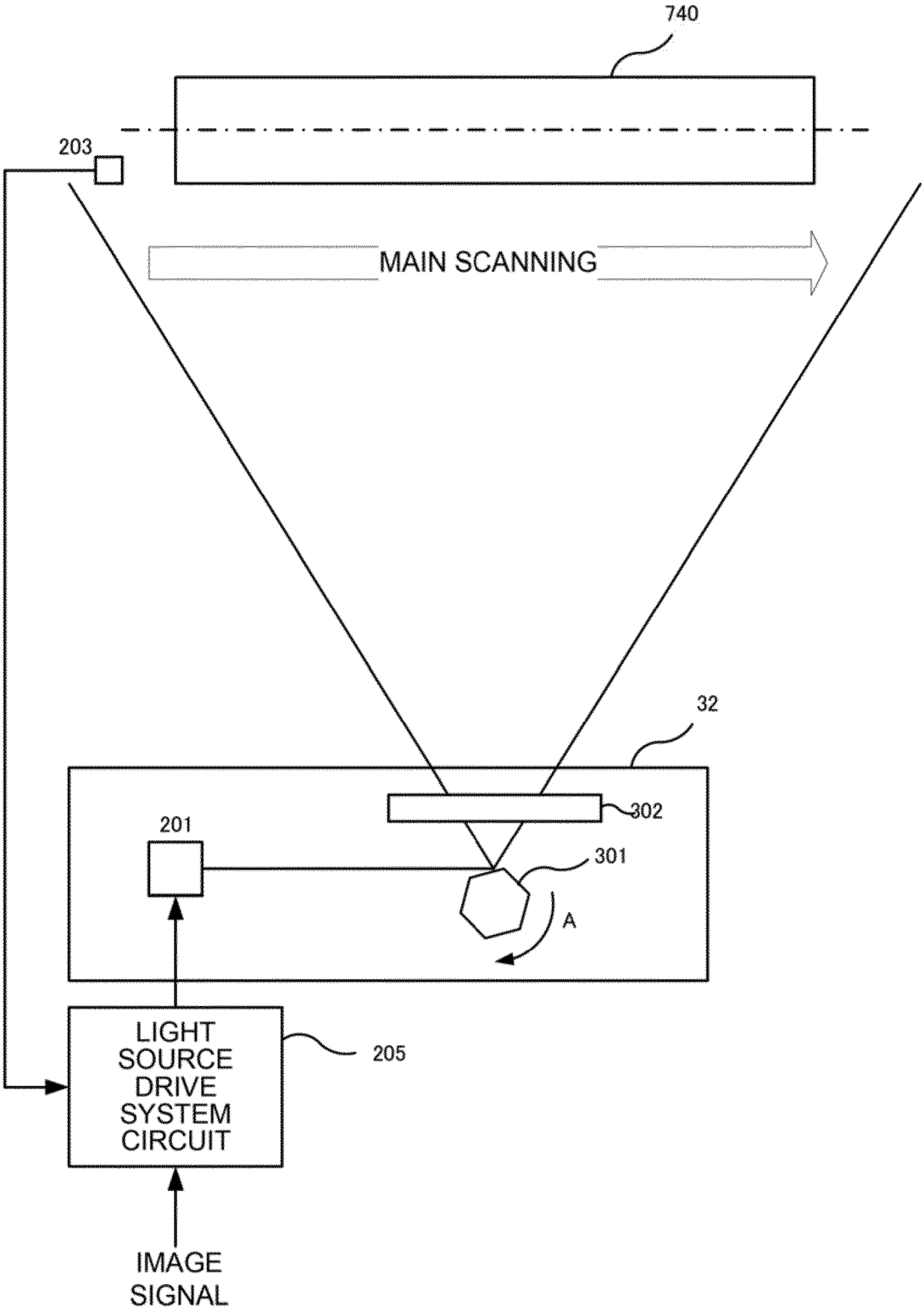
FIG. 4 is a schematic diagram of a configuration of an image forming device included in an electrophotographic multifunction apparatus according to a first embodiment of the present invention.

FIG. 4 is a schematic diagram of a configuration of an image forming device included in an electrophotographic multifunction apparatus.

With reference to FIG. 4, laser light emitted from a laser emission source 201 is converted into scanning light with which a photosensitive drum 740 is scanned in a main scanning direction by a polygon mirror 301 rotating as illustrated by an arrow A. Here, over an optical path from the polygon mirror 301 to the photosensitive drum 740, an optical system component 302 such as a lens is arranged.

In an initial stage of a main scanning, the laser light is detected by a detector 203 for BD detection to achieve synchronization in the main scanning direction based on a detection timing.

Further, a detection signal based on the laser light detected by the BD detector 203 is supplied to a light source drive system circuit 205. Based on a level of the detection signal, APC for adjusting laser light intensity in a sub scanning direction is performed.

An image signal is also supplied to the light source drive system circuit 205. From the light source drive system circuit 205, a laser emission source drive signal, which undergoes intensity adjustment by the APC in the sub scanning direction, a shading correction by a shading correction signal generation circuit in the main scanning direction, and modification by the image signal, is output.

Figure 5:
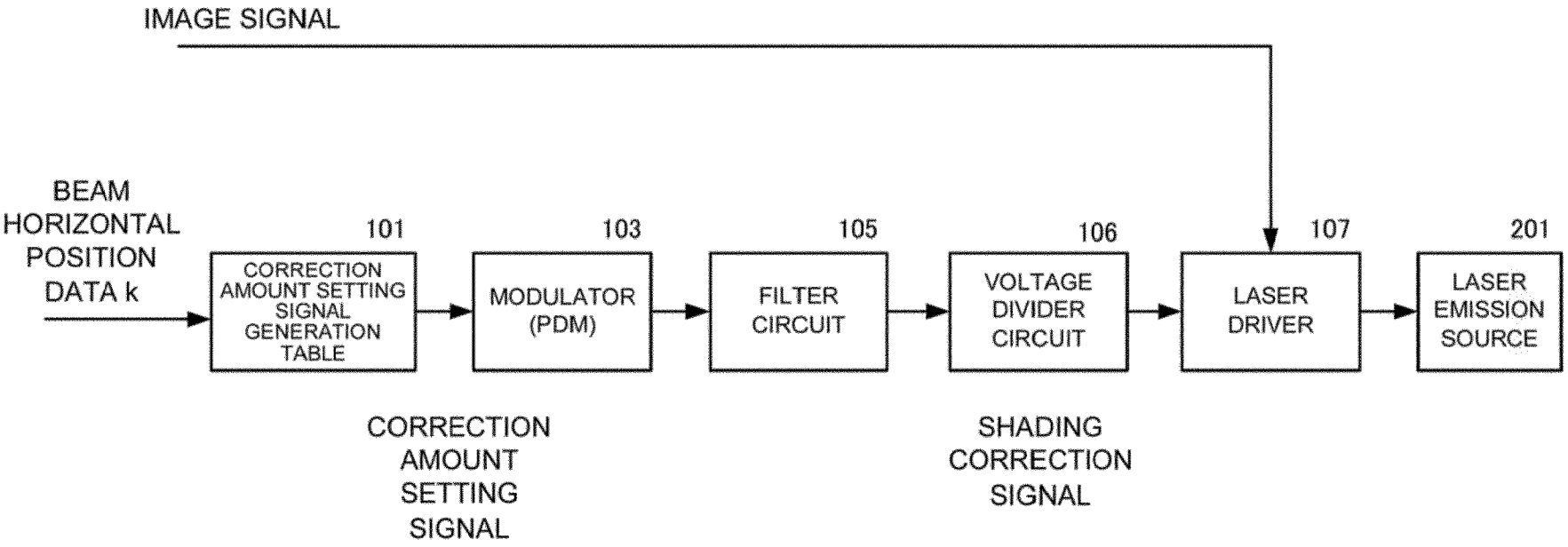
FIG. 5 is a block diagram illustrating a configuration of a shading correction signal generation device according to first and second embodiments of the present invention.

FIG. 5 illustrates a shading correction signal generation device according to the first embodiment. The shading correction signal generation device configures a part of the light source drive system circuit 205.

With reference to FIG. 5, the shading correction signal generation device includes a correction amount setting signal generation table 101, a modulator 103, a filter circuit 105, a voltage divider circuit 106, and a laser driver 107.

The correction amount setting signal generation table 101 generates a correction amount setting signal (see FIG. 7) represented by digital data, based on beam horizontal position data k.

The modulator 103 modulates the correction amount setting signal by a predetermined modulation scheme to generate the modulation signal. As the predetermined modulation scheme, for example, pulse density modulation (PDM) is used. As the PDM, for example, a delta-sigma modulation is used.

The filter circuit 105 generates an analog shading correction signal (see FIG. 7) having a level corresponding to a level indicated by the correction amount setting signal, based on the modulation signal generated by the modulator 103. The filter circuit 105 is, for example, a first-order or higher-order low-pass filter. Further, the filter circuit 105 includes a configuration by which the modulation signal output from the modulator 103 is divided at a position within a predetermined distance from an inputter of the laser driver 107 that generates a light source drive signal to drive the laser emission source 201, and is supplied to the laser driver 107 (see FIG. 6).

Figure 6:
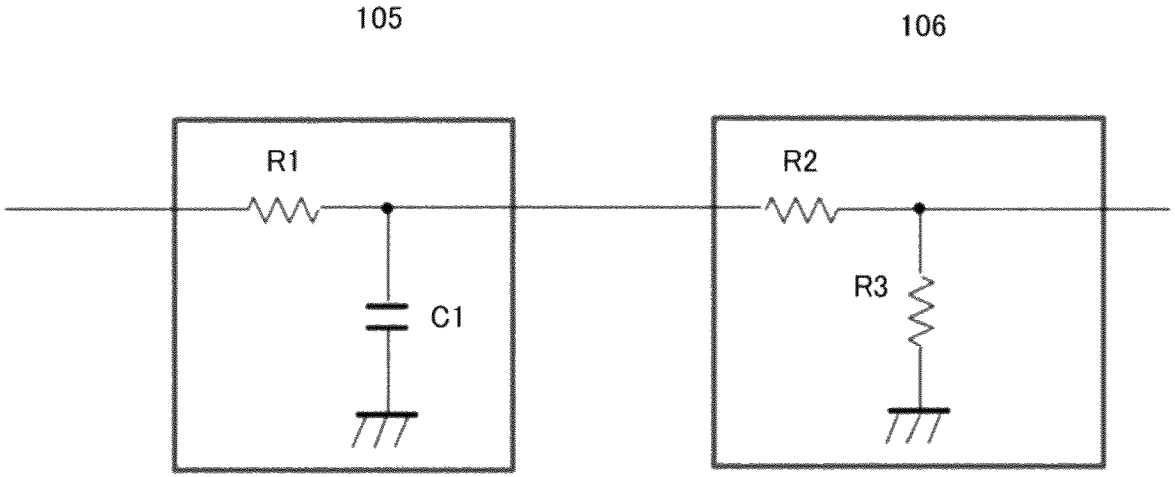
FIG. 6 is a circuit diagram illustrating an example of a configuration of a filter circuit and a voltage divider circuit illustrated in FIG. 5.

The voltage divider circuit 106 divides an output signal of the filter circuit 105 (see FIG. 6).

The laser driver 107 generates a drive signal to drive the laser emission source 201, based on the image signal and the shading correction signal, and outputs the drive signal to the laser emission source 201. The level of the drive signal corresponds to the level of the shading correction signal. If the image signal is subjected to pulse width modulation (PWM), the drive signal is similarly modulated.

Figure 7:
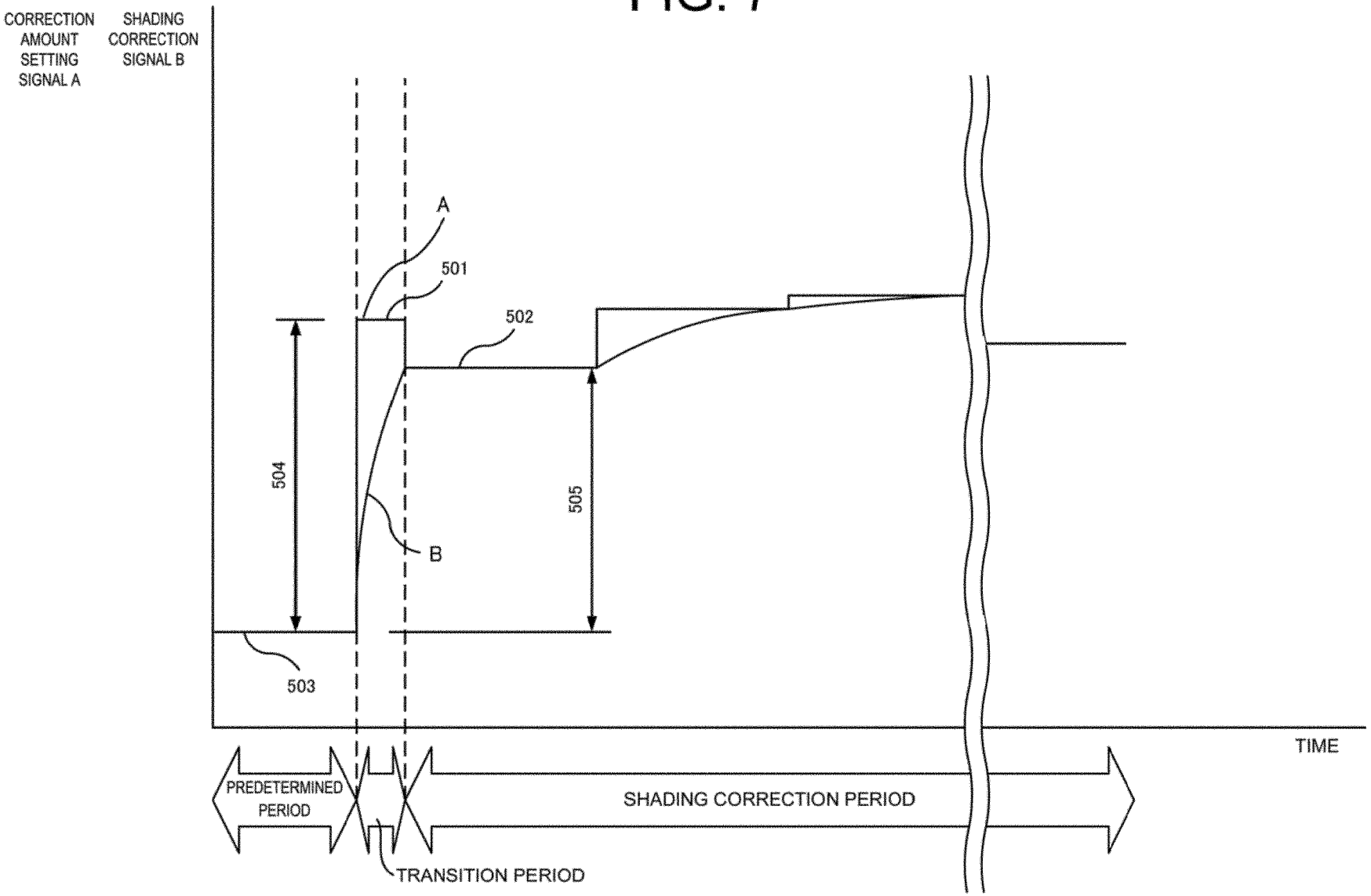
FIG. 7 is a graph showing a waveform of a correction amount setting signal and a waveform of a shading correction signal according to the first embodiment of the present invention.

In the first embodiment, as illustrated in FIG. 7, a correction amount setting signal A in which a difference between a level at an end of a predetermined period and an average level during a transition period is larger than a difference between the level at the end of the predetermined period and a level at a start of a shading correction period, is generated. Here, the predetermined period is, for example, a BD detection and an APC period.

Figure 1:
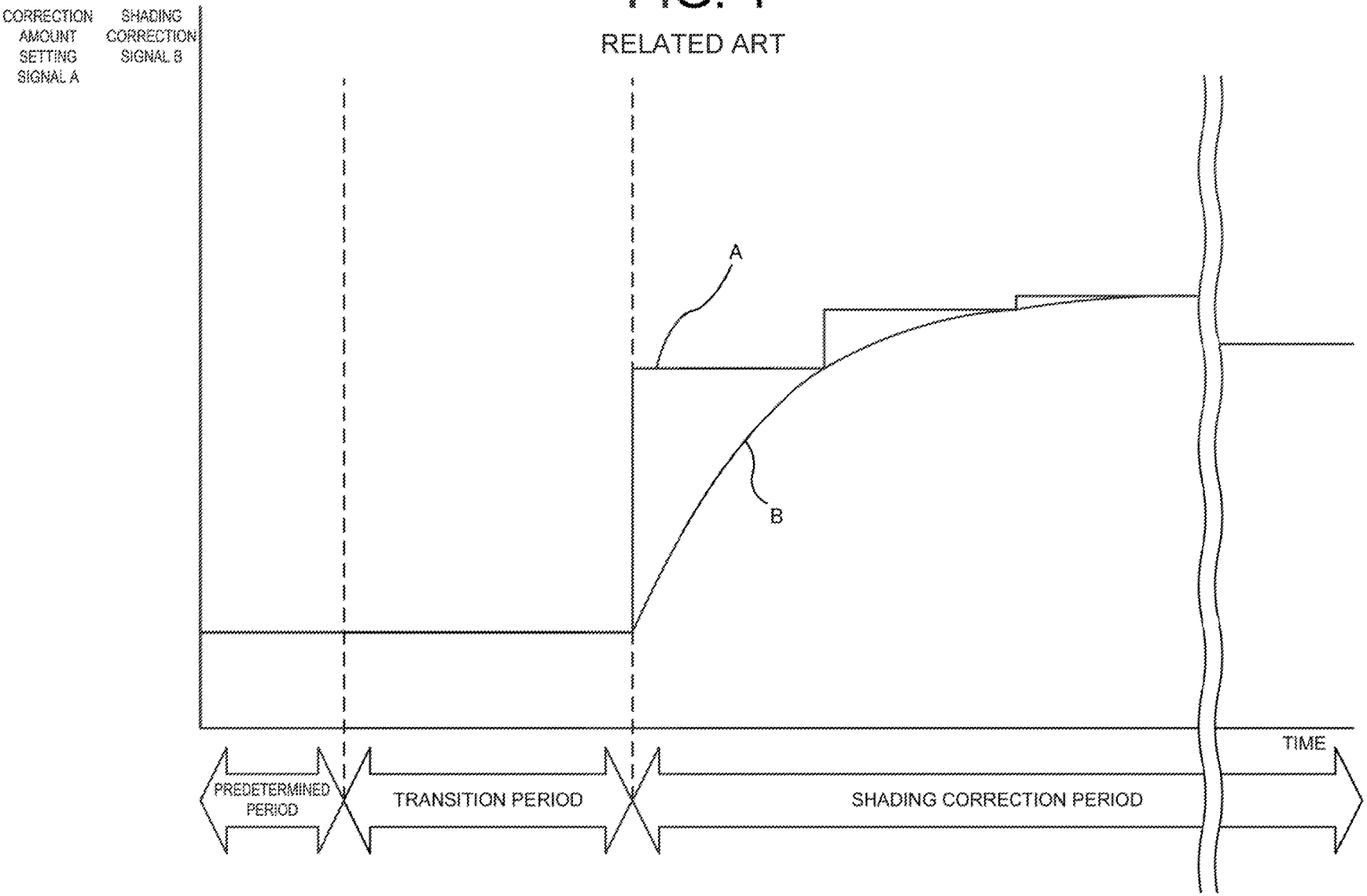
FIG. 1 RELATED ART
FIG. 1 is a graph showing a waveform of a correction amount setting signal and a waveform of a shading correction signal according to a conventional example.
Figure 2:
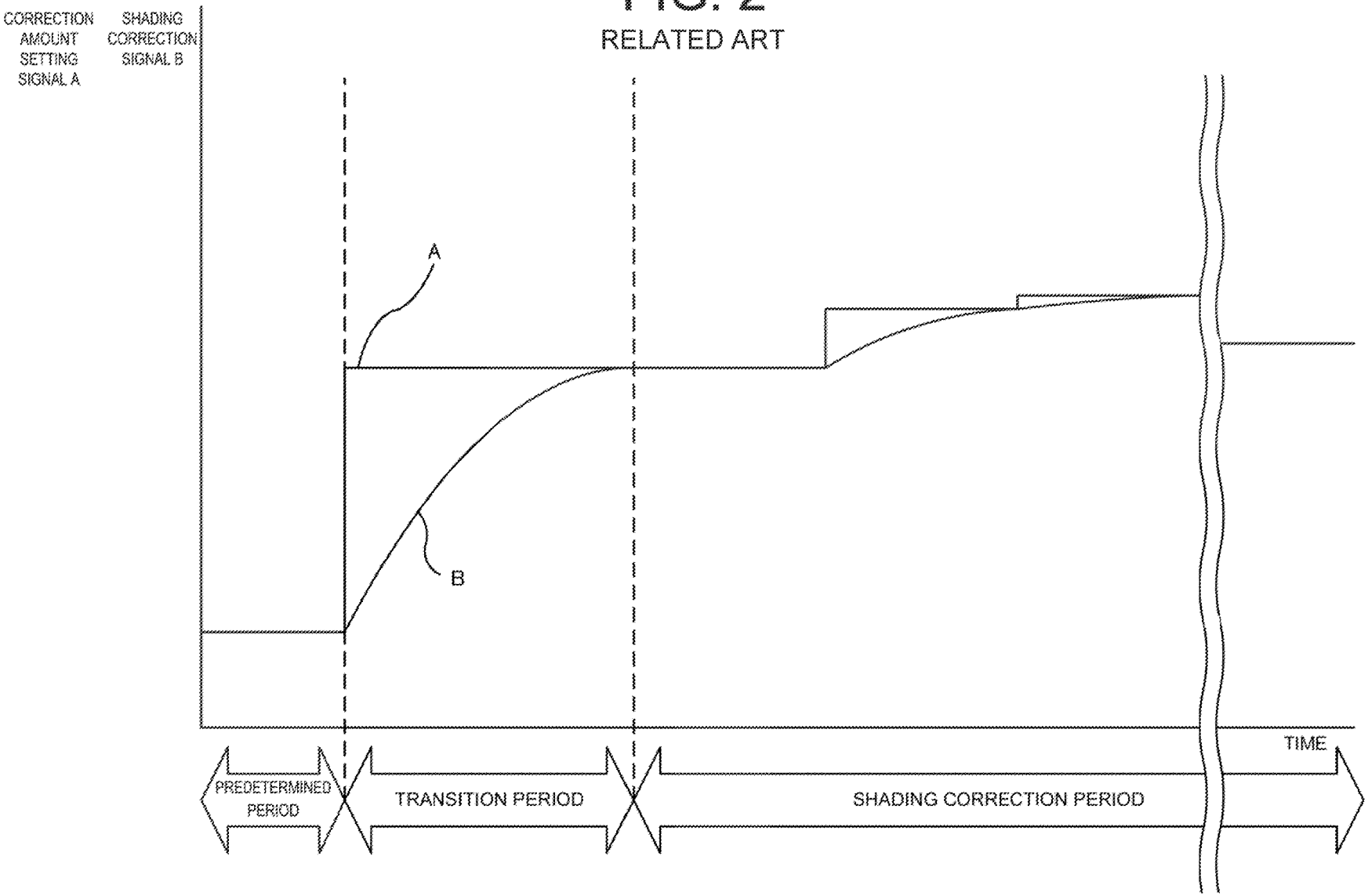
FIG. 2 RELATED ART
FIG. 2 is a graph showing a waveform of a correction amount setting signal and a waveform of a shading correction signal according to another conventional example.
Figure 3:
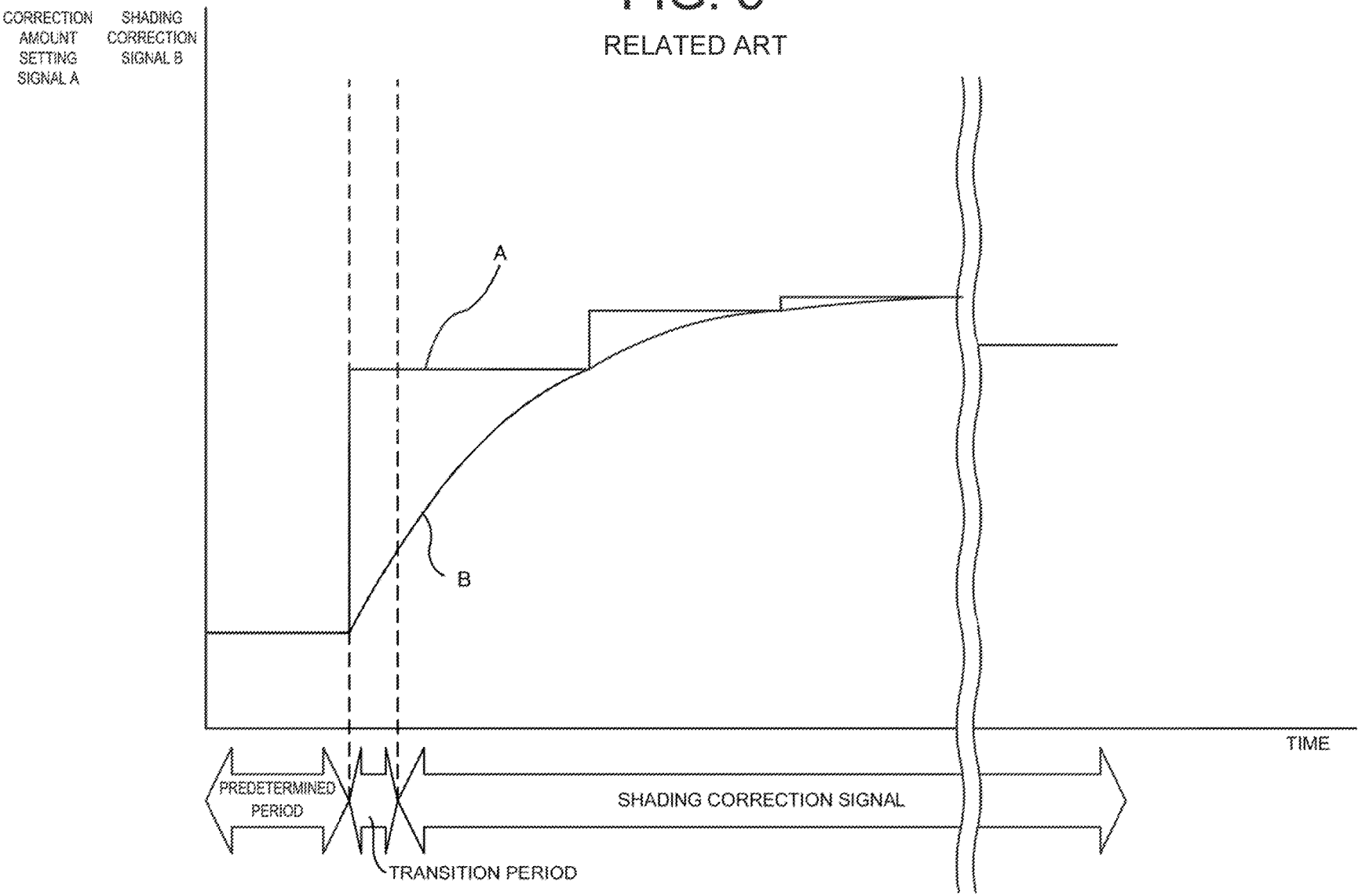
FIG. 3 RELATED ART
FIG. 3 is a graph showing a waveform of a correction amount setting signal and a waveform of a shading correction signal according to another conventional example when a transition period is short.

As a result, the level of the shading correction signal sharply increases as compared with the example described with reference to FIG. 3. Therefore, as illustrated in FIG. 7, at the start of the shading correction period, it is possible to equalize the level of the shading correction signal to a level of a shading correction signal galvanically corresponding to the correction amount setting signal adjusted for the shading correction at the start of the shading correction period.

Second Embodiment

A shading correction signal generation device according to a second embodiment is configured similarly to the shading correction signal generation device (illustrated in FIG. 5) according to the first embodiment.

Figure 8:
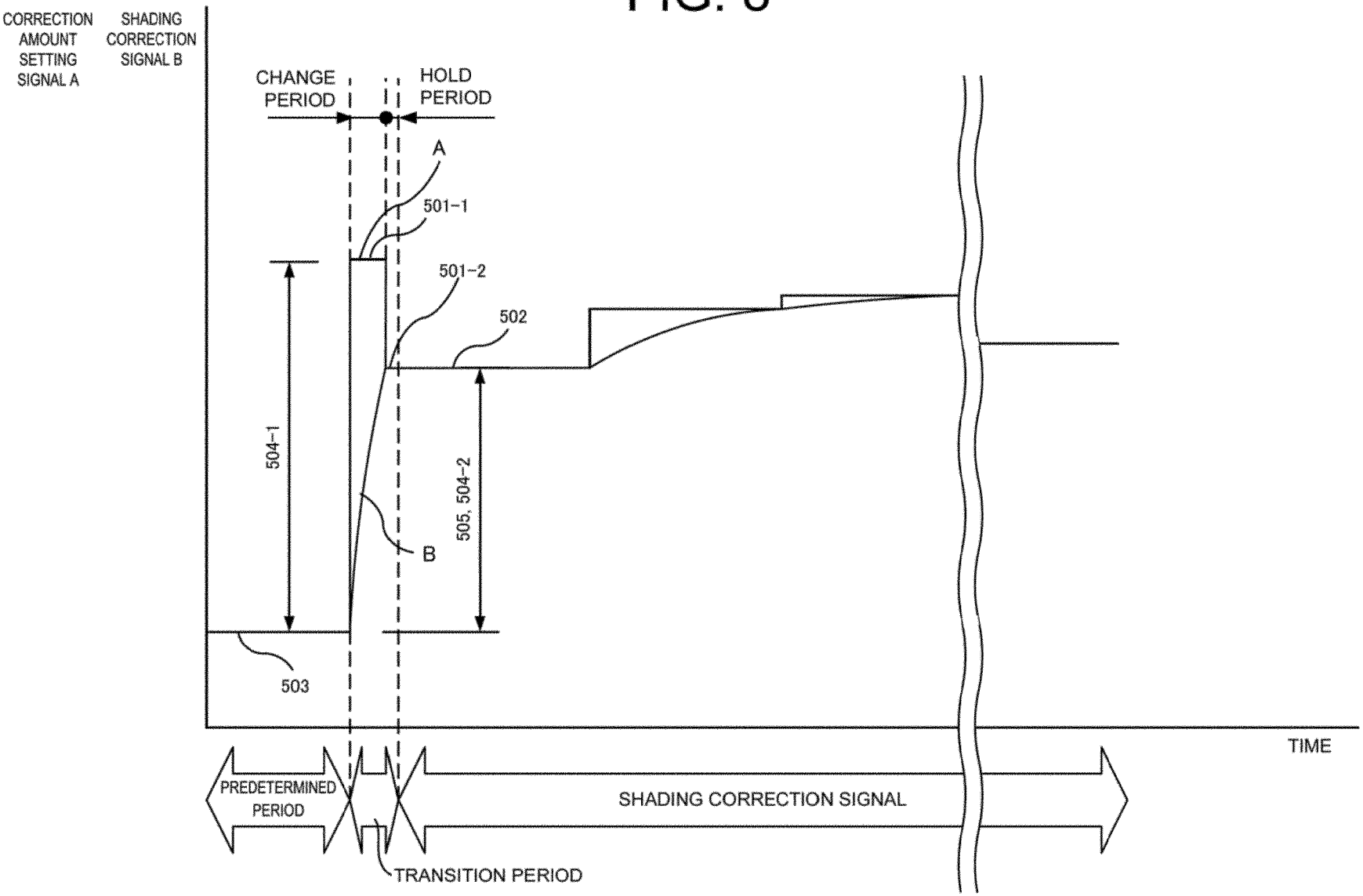
FIG. 8 is a graph showing a waveform of a correction amount setting signal and a waveform of a shading correction signal according to the second embodiment of the present invention.

In the second embodiment, as illustrated in FIG. 8, a hold period having a fixed length is provided at an end of the transition period from the end of the predetermined period to the start of the shading correction period. A level 501-2 of the correction amount setting signal during the hold period is set identical to a level 502 of the correction amount setting signal at the start of the shading correction period.

The level of the correction amount setting signal in a period from the start of the transition period to the start of the hold period (change period) is adjusted so that the level of the shading correction signal at the start of the hold period reaches the level of the shading correction signal at the start of the shading correction period. With such adjustment, it is possible to absorb variation in response characteristics due to variation in elements used in the filter circuit 105.

In explanation of a series of adjustments, input/output characteristics of the modulator 103 and a gain adjuster (not illustrated) are adjusted so that desired laser light intensity is obtained during the shading correction period. Thus, the level of the shading correction signal is adjusted during the shading correction period. Next, for example, if the level of the shading correction signal at the start of the hold period is lower than the level of the shading correction signal at the start of the shading correction period due to the variation in the elements used in the filter circuit 105, a level 501-1 of the correction amount setting signal during the change period is raised. Conversely, if the level of the shading correction signal at the start of the hold period is higher than the level of the shading correction signal at the start of the shading correction period due to the variation in the elements used in the filter circuit 105, the level 501-1 of the correction amount setting signal during the change period is lowered.

It is noted that even if the level of the shading correction signal at the start of the hold period is lower than the level of the shading correction signal at the start of the shading correction period due to the variation in the elements used in the filter circuit 105, when the level of the shading correction signal reaches the level of the shading correction signal at the start of the shading correction period before the hold period ends, it is not necessary to adjust the level 501-1 of the correction amount setting signal during the change period. Further, even if the level of the shading correction signal at the start of the hold period is higher than the level of the shading correction signal at the start of the shading correction period due to the variation in the elements used in the filter circuit 105, when the level of the shading correction signal reaches the level of the shading correction signal at the start of the shading correction period before the hold period ends, it is not necessary to adjust the level 501-1 of the correction. amount setting signal during the change period.

Third Embodiment

Figure 9:
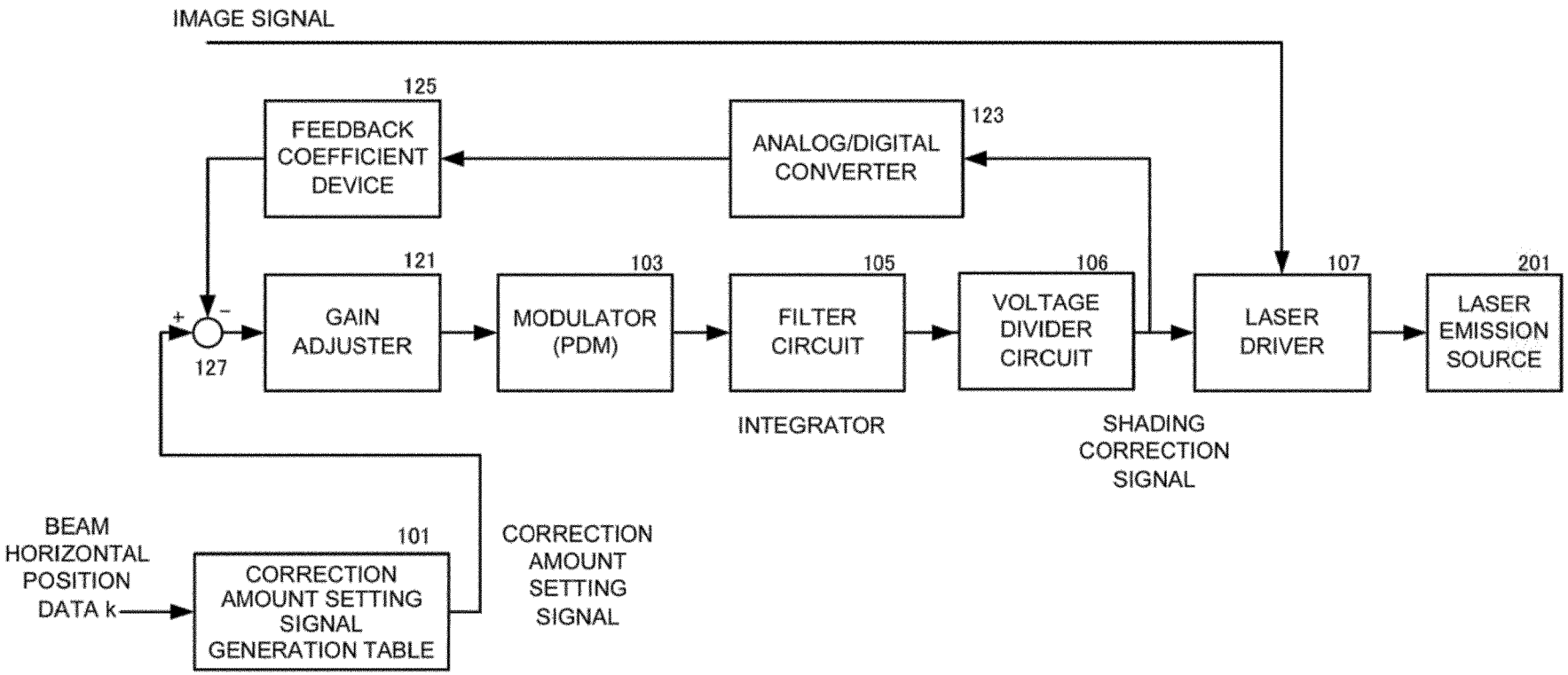
FIG. 9 is a block diagram illustrating a configuration of a shading correction signal generation device according to a third embodiment of the present invention.

FIG. 9 illustrate a shading correction signal generation device according to a third embodiment.

With reference to FIG. 9, the shading correction signal generation device includes the correction amount setting signal generation table 101, the modulator 103, the filter circuit 105, the voltage divider circuit 106, the laser driver 107, a subtractor 127, a gain adjuster 121, an analog/digital converter 123, and a feedback coefficient device 125.

The correction amount setting signal generation table 101 generates a correction amount setting signal represented by digital data, based on the beam horizontal position data k.

The subtractor 127 subtracts a feedback signal represented by digital data from the correction amount setting signal represented by digital data to generate a difference signal represented by digital data.

The gain adjuster 121 amplifies the difference signal represented by digital data with a predetermined gain.

The modulator 103 modulates the difference signal represented by the digital data after the amplification by a predetermined modulation scheme to generate the modulation signal. As the predetermined modulation scheme, for example, PDM is used. As the PDM, for example, a delta-sigma modulation is used.

The filter circuit 105 generates an analog shading correction signal having a level corresponding to a level indicated by the correction amount setting signal, based on the modulation signal generated by the modulator 103.

The voltage divider circuit 1106 divides an output signal of the filter circuit 105.

The laser driver 107 generates a drive signal to drive a laser emission source 201, based on an image signal and the shading correction signal, and outputs the drive signal to the laser emission source 201. The level of the drive signal corresponds to the level of the shading correction signal. If the image signal is PWM-modulated, the drive signal is similarly modulated.

The analog/digital converter 123 converts the shading correction signal into digital data.

The feedback coefficient device 125 multiplies the shading correction signal converted into digital data by a feedback coefficient to obtain a feedback signal represented by digital data.

Figure 14:
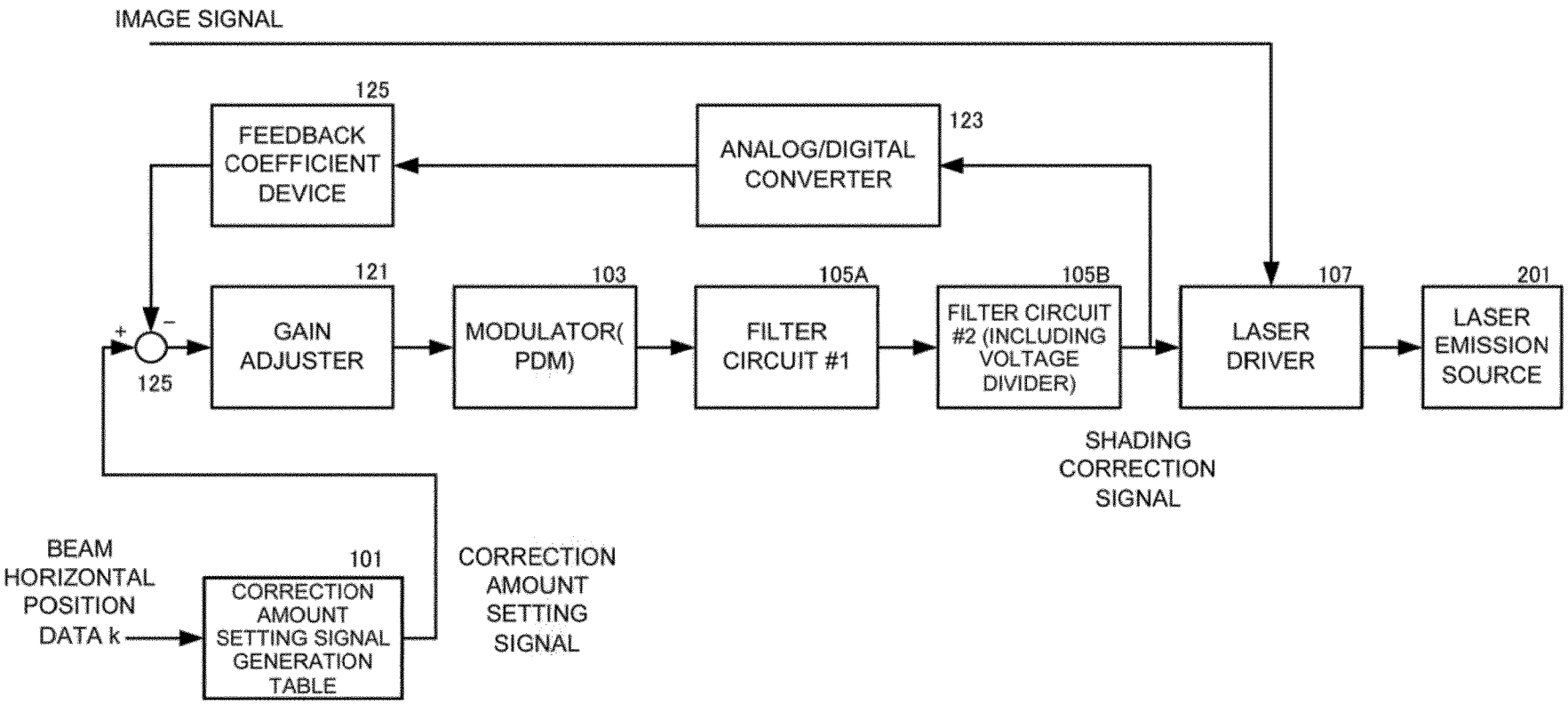
FIG. 14 is a block diagram illustrating a configuration of a shading correction signal generation device according to a fifth embodiment of the present invention.

In the first and second embodiments, the modulator 103 and the filter circuit 105 are used as a circuit for generating the shading correction signal, based on the correction amount setting signal; however, in the third embodiment, the above-described circuit (including the subtractor 127, the gain adjuster 121, the modulator 103, the filter circuit 105, the analog/digital converter 123, and the feedback coefficient device 125) as illustrated in FIG. 14 is used.

Figure 10:
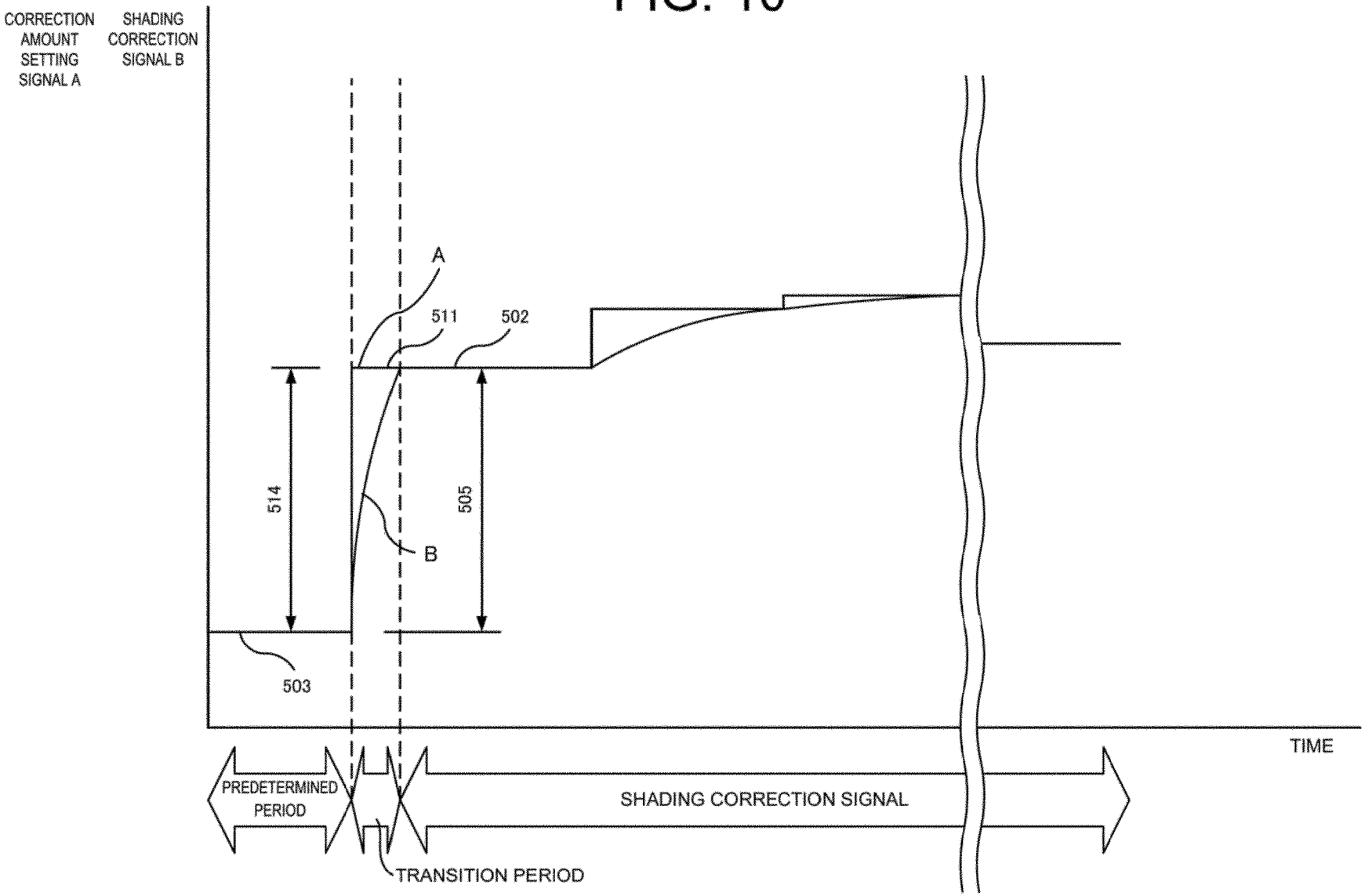
FIG. 10 is a graph showing a waveform of a correction amount setting signal and a waveform of a shading correction signal according to the third embodiment of the present invention.

In the third embodiment, as illustrated in FIG. 10, during the transition period from the end of the predetermined period to the start of the shading correction period, the correction amount setting signal is generated by which a level 511 during the transition period is adjusted so that when compared to the level 502 adjusted for the shading correction at the start of the shading correction period, a difference 514 between the level 511 and. the level 503 at the end of the predetermined period and a difference 505 between the level 502 and the level 503 become the same.

In the conventional example, the shading correction signal is generated by passing the correction amount setting signal through a normal low-pass filter. Therefore, at the start of the shading correction period, as a result of the variation in response characteristics due to the variation in the elements of the filter circuit, it is difficult to align the level of the shading correction signal to the level of the shading correction signal galvanically corresponding to the correction amount setting signal adjusted for the shading correction at the start of the shading correction period.

On the other hand, in the third embodiment, the feedback circuit as illustrated in FIG. 9 is used, and thus, it is possible to correct a PDM command value to be supplied to the modulator 103 in real time to compensate for the variation in the response characteristics due to the variation in the elements of the filter circuit, and therefore, at the start of the shading correction period as illustrated in FIG. 10, it is possible to equalize the level 511 of the shading correction signal to the level 502 of the shading correction signal galvanically corresponding to the correction amount setting signal adjusted for the shading correction at the start of the shading correction period.

Further, if it may suffice that the response is fastened and the response is not varied only during the transition period, the feedback calculation need not be performed during the shading correction period.

Fourth Embodiment

Figure 11:
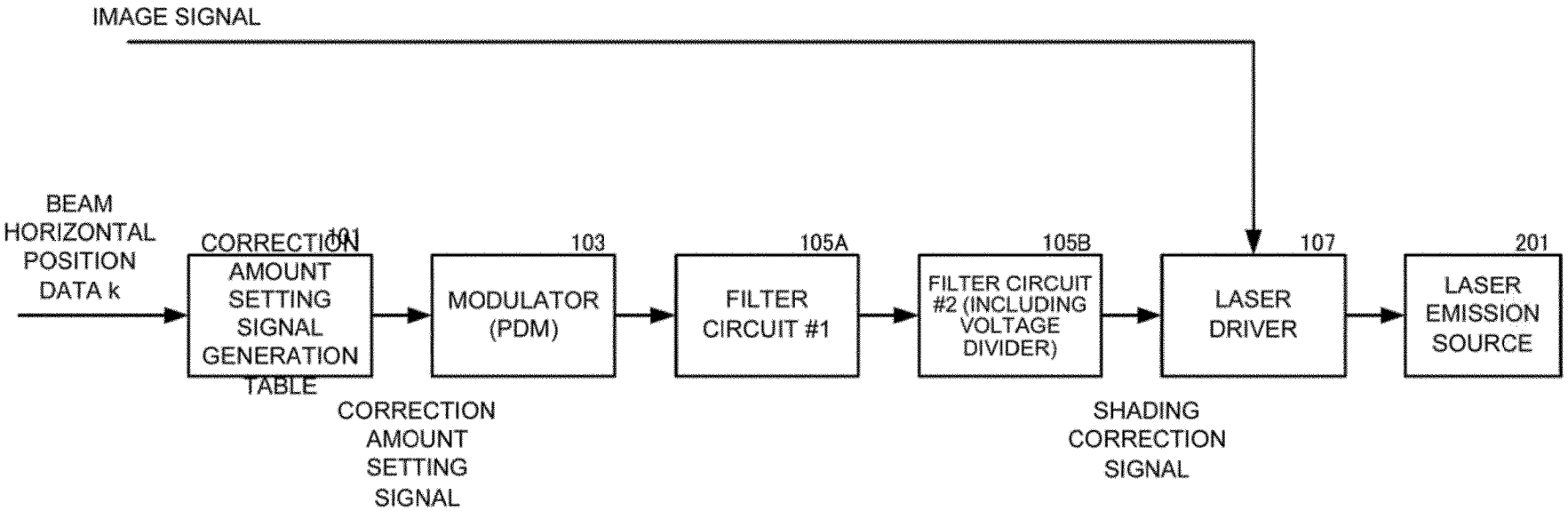
FIG. 11 is a block diagram illustrating a configuration of a shading correction signal generation device according to a fourth embodiment of the present invention.

In a fourth embodiment, the configuration of the shading correction signal generation device according to the first embodiment or the second embodiment as illustrated in FIG. 5 is modified to a configuration as illustrated in FIG. 11.

In the fourth embodiment, the filter circuit 105 is modified to a two-part configuration including a filter circuit #1 105A and a filter circuit #2 105B.

The filter circuit #1 105A is arranged at a position within predetermined distance from the modulator 103.

The filter circuit #1 105A is a low-pass filter circuit having an order of 1 or more.

The filter circuit #2 105B is arranged at a position within a predetermined distance from the inputter of the laser driver 107 to which the shading correction signal is supplied.

The filter circuit #2 105B is a low-pass filter circuit having an order of 1 or more.

Further, the filter circuit #2 105B includes a configuration by which the modulation signal output from the modulator 103 is divided at a position within a predetermined distance from the inputter of the laser driver 107 that generates a light source drive signal to drive the laser emission source 201, and is supplied to the laser driver 107.

Figure 12:
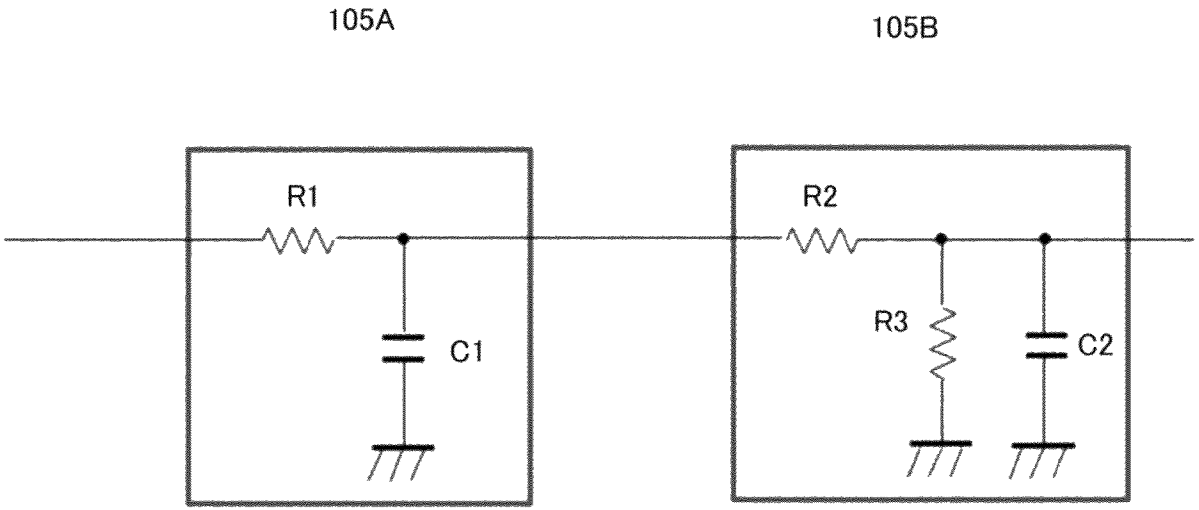
FIG. 12 is a circuit diagram illustrating an example of a configuration of a filter circuit #1 and a filter circuit #2 illustrated in FIG. 11.

The filter circuit #1 105A and the filter circuit #2 105B may be configured as illustrated in FIG. 12.

Figure 13:
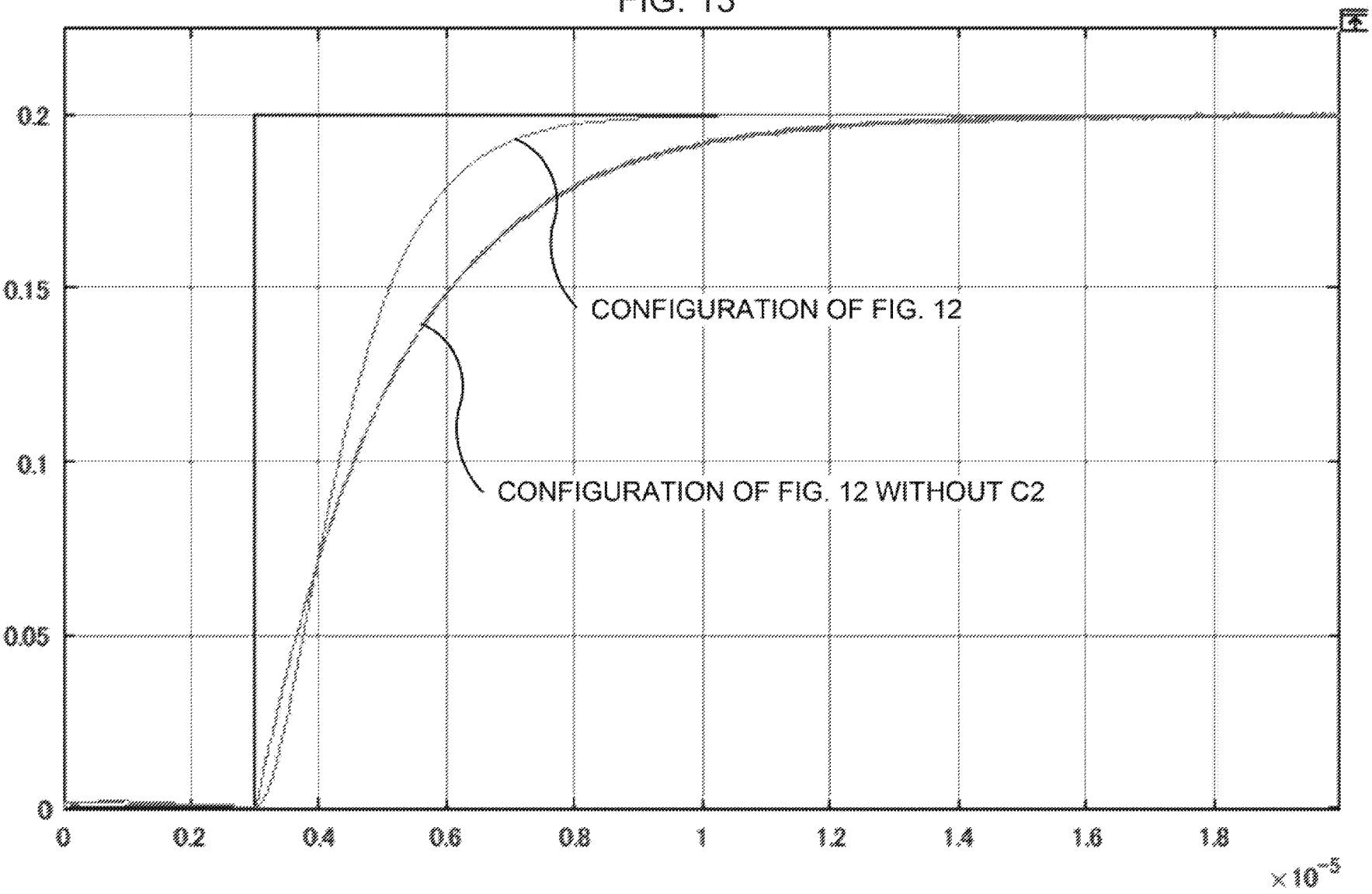
FIG. 13 is a graph showing waveforms of step response signals of the filter circuit #1 and the filter circuit #2 illustrated in FIG. 6 for a step input signal, and waveforms of step response signals of the filter circuit #1 and the filter circuit #2 illustrated in FIG. 12 for a step input signal.

Two step response waveforms illustrated in FIG. 13 correspond to the configurations illustrated in FIG. 6 and. FIG. 12. Accordingly, it can be seen that as compared to the configuration illustrated in FIG. 6, in the configuration illustrated in FIG. 12, a capacity is added, and thus, a rise appears earlier and a ripple is reduced.

Fifth Embodiment

In a fifth embodiment, the configuration of the shading correction signal generation device according to the third embodiment as illustrated in FIG. 9 is modified to a configuration as illustrated in FIG. 14.

As with the fourth embodiment, the filter circuit 105 is modified to the two-part configuration including the filter circuit #1 105A and the filter circuit #2 105B.

The filter circuit #1 105A is arranged at a position within a predetermined distance from the modulator 103.

The filter circuit #1 105A is a low-pass filter circuit having an order of 1 or more.

The filter circuit #2 105B is arranged at a position within a predetermined distance from the inputter of the laser driver 107 to which the shading correction signal is supplied.

The filter circuit #2 105B is a low-pass filter circuit having an order of 1 or more.

Further, the filter circuit #2 105B may include a configuration by which the modulation signal output from the modulator 103 is divided at a position within a predetermined distance from the inputter of the laser driver 107 that generates a light source drive signal to drive the laser emission source 201, and is supplied to the laser driver 107.

The filter circuit #1 105A and the filter circuit #2 105B can be described in much the same way as those of the fourth embodiment, and thus, duplicate description will be omitted.

Sixth Embodiment

A configuration of a shading correction signal generation device according to a sixth embodiment is similar to that of the shading correction signal generation device (illustrated in FIG. 5) according to the first embodiment.

In the second embodiment, the shading correction period is divided in N segments and the level of the correction amount setting signal during the hold period and the level of the correction amount setting signal in a first segment are the same, and thus, in the first segment, the shading correction signal is galvanized and is unchanged.

On the other hand, in the sixth embodiment, the level of the correction amount setting signal during the hold period is differed from the level of the correction amount setting signal in the first segment during the shading correction period.

Figure 15:
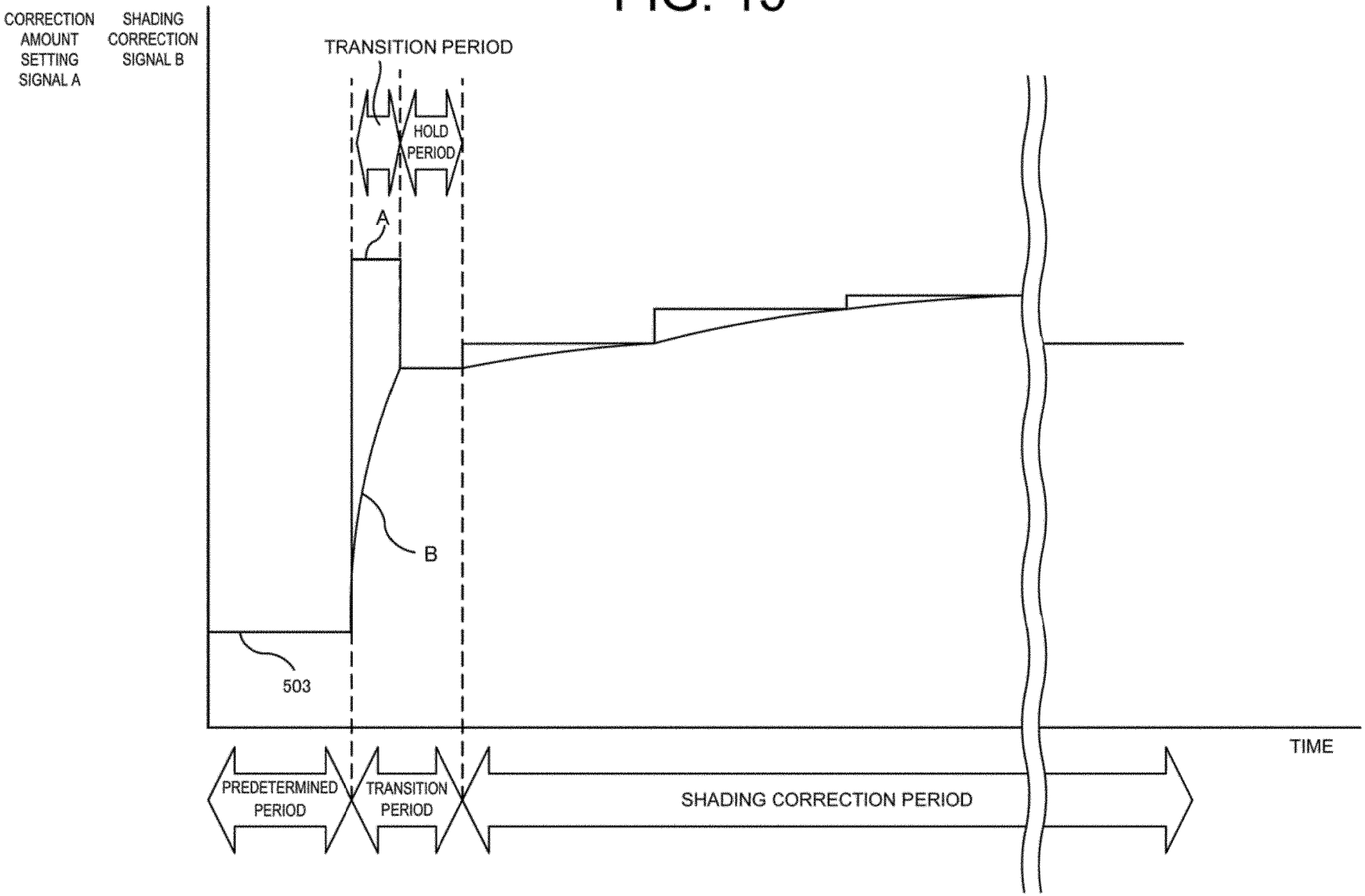
FIG. 15 is a graph showing another example of a waveform of a correction amount setting signal and a waveform of a shading correction signal according to a sixth embodiment of the present invention.

FIG. 15 illustrates an example where the level of correction amount setting signal during the change period is set to a level higher than the level corresponding to the level of the shading correction signal at the start of the shading correction period, and the level of the correction amount setting signal during the hold period is set to the level corresponding to the level of the shading correction signal at the start of the shading correction period.

Thus, it is possible to change the shading correction signal in the first segment during the shading correction period.

Therefore, the sixth embodiment can he applied to a case where the level of the required shading correction signal is changed from the first segment.

It is noted that also in the sixth embodiment, if there is no need of differing the levels, the level of the correction amount setting signal during the hold period may be set equal to the level of the correction amount setting signal in the first segment during the shading correction period.

Seventh Embodiment

Figure 16:
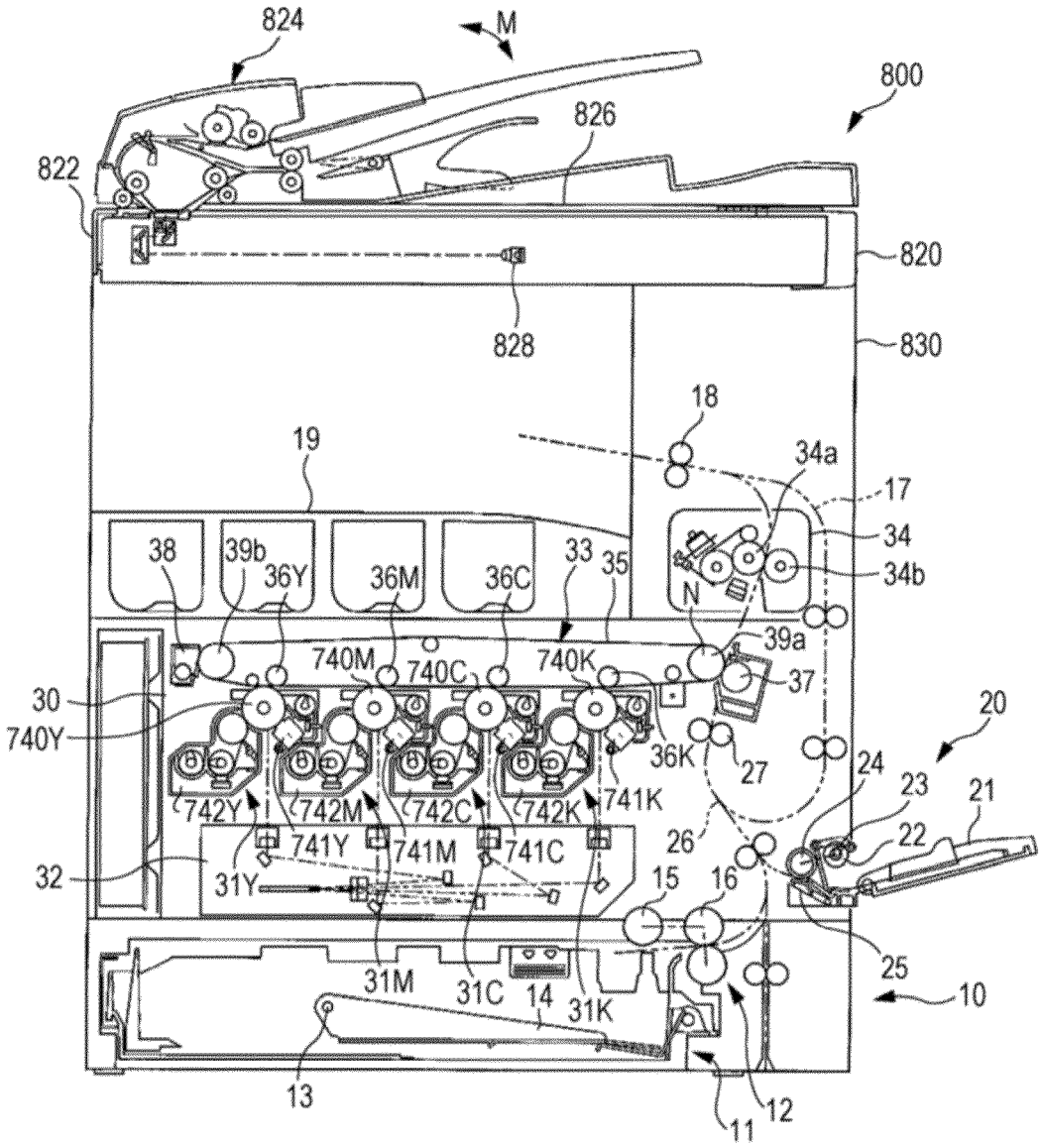
FIG. 16 is a conceptual cross-sectional view of a multifunction apparatus according to a seventh embodiment of the present invention.
Figure 17:
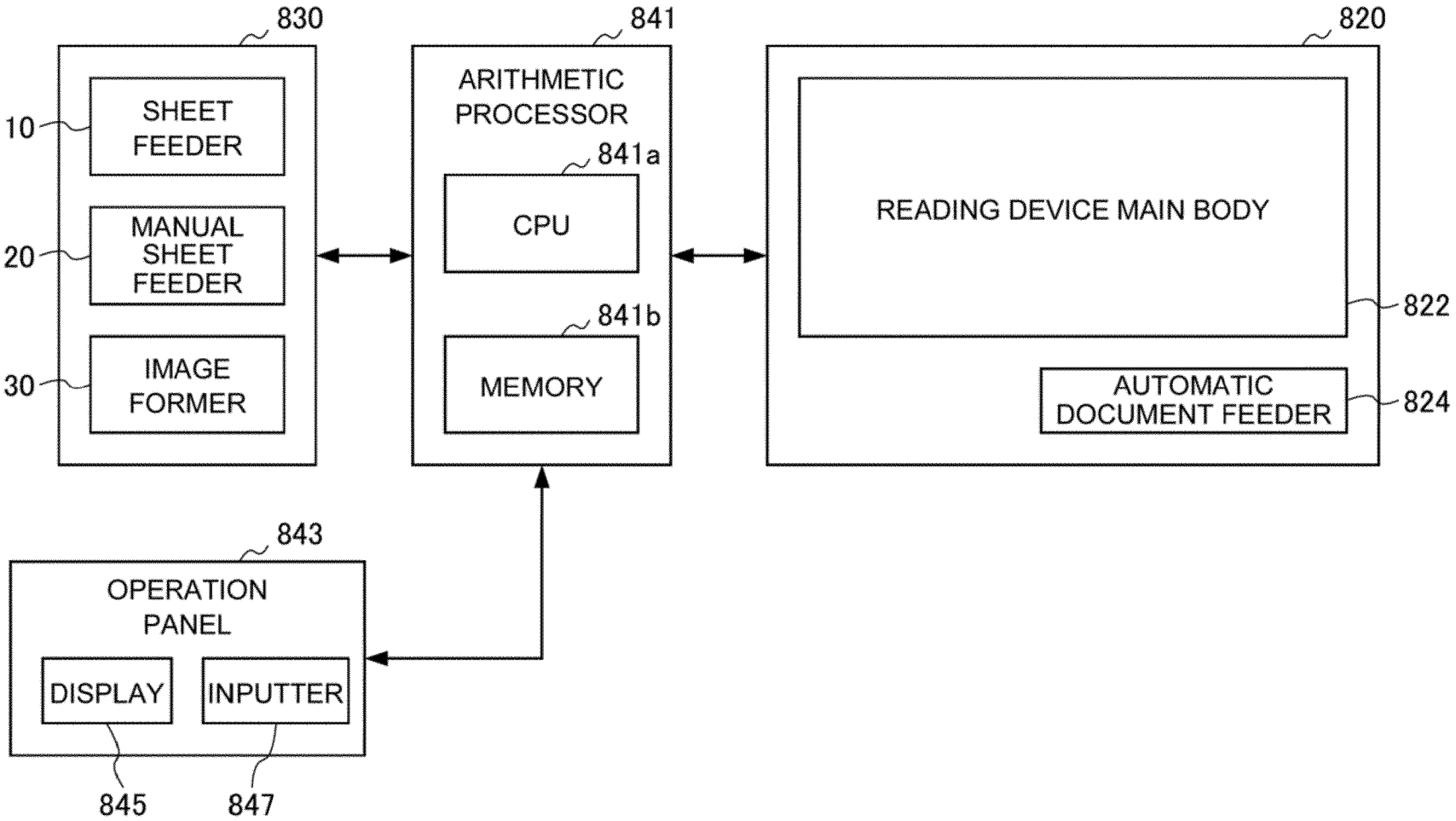
FIG. 17 is a functional block diagram of the multifunction apparatus according to the seventh embodiment of the present invention.

A seventh embodiment relates to a multifunction apparatus 800 including a document reading device according to the first to fifth embodiments. FIG. 16 and FIG. 17 illustrate a configuration of the multifunction apparatus 800, for example.

As illustrated in FIG. 16 and FIG. 17, the multifunction apparatus 800 includes a document reading device 820 that reads an image of a document, a multifunction apparatus main body (image former main body) 830 that forms an image on a sheet, an operation panel 843 that operates the document reading device 820 and the multifunction apparatus main body 830, and an arithmetic processor 841 that controls the document reading device 820 and the multifunction apparatus main body 830 based on an operation through the operation panel 843.

In addition to using the document reading device 820 alone for reading an image and using the multifunction apparatus main body 830 alone for forming an image, the document reading device 820 and the multifunction apparatus main body 830 can also be linked to copy an image. The multifunction apparatus 800 may include a storage device and a facsimile device (not illustrated). The storage device can store an image read by the document reading device 820 and an image received by the facsimile device. The facsimile device can transmit an image read by the document reading device 820 and an image stored in the storage device, and can receive an image from the outside. Furthermore, the multifunction apparatus 800 may include an interface for connecting to a personal computer via a network. The personal computer connected to the multifunction apparatus 800 can use the function of the multifunction apparatus for data to be managed.

The document reading device 820 includes an automatic document feeder SPF (Single Pass Feeder) 824 that automatically feeds a document, and a reading device main body 822 that reads an image of the document. It is noted that in addition to the components illustrated in FIG. 17, the document reading device 820 also includes components illustrated in FIG. 16 but not illustrated in FIG. 17. Further, as illustrated in FIG. 16, the reading device main body 822 includes a platen 826.

The multifunction apparatus main body 830 includes a sheet feeder 10 that feeds sheets, a manual sheet feeder 20 that manually feeds sheets, and an image former 30 that forms an image on a sheet fed by the sheet feeder 10 or the manual sheet feeder 20.

The sheet feeder 10 includes a sheet stacker 11 in which sheets are stacked and a separation feeder 12 that separates and feeds the sheets stacked on the sheet stacker 11 one by one. The sheet stacker 11 includes an intermediate plate 14 that turns about a rotation shaft 13. The intermediate plate 14 turns to lift a sheet upward when the sheet is fed. The separation feeder 12 includes a pickup roller 15 that feeds a sheet lifted by the intermediate plate 14 and a pair of separation rollers 16 that separates the sheet fed by the pickup roller 15 one by one.

The manual sheet feeder 20 includes a manual feed tray 21 on which sheets are stackable and a separation feeder 22 that separates and feeds the sheets stacked on the manual feed tray 21 one by one. The manual feed tray 21 is turnably supported by the multifunction apparatus main body 830, and can be fixed at a predetermined angle so that sheets can be stacked if the sheets are manually fed. The separation feeder 22 includes a pickup roller 23 that feeds sheets stacked on the manual feed tray 21, and a separation roller 24 and a separation pad 25 that separate the sheets fed by the pickup roller 23 one by one.

The image former 30 includes four process cartridges 31Y to 31K that form yellow (Y), magenta (M), cyan (C), and black (K) images, respectively, photosensitive drums 740Y to 740K, which will be described below, an exposure device 32 that exposes the surfaces of the photosensitive drums, a transferer 33 that transfers toner images formed on the surfaces of the photosensitive drums 740Y to 740K onto a sheet, and a fixer 34 that fixes the transferred toner images onto the sheet. It is noted that the alphabets (Y, M, C, K) appended to the end of the reference numerals indicate the respective colors (yellow, magenta, cyan, black).

Each of the four process cartridges 31Y to 31K is removable from the multifunction apparatus main body 830 to be replaceable. It is noted that the four process cartridges 31Y to 31K have the same configuration except that the color of the image to be formed is different, and thus, only the configuration of the process cartridge 31Y that forms a yellow (Y) image will be described, and the explanation of the process cartridges 31M to 31K is omitted accordingly.

The process cartridge 31Y includes the photosensitive drum 740Y serving as an image carrier, a charger 741Y that charges the photosensitive drum 740Y, a developing device 742Y that develops an electrostatic latent image formed on the photosensitive drum 740Y, and a drum cleaner (not illustrated) that removes toner remaining on the surface of the photosensitive drum 740Y. The developing device 742Y includes a developing device main body (not illustrated in detail) that develops the photosensitive drum 740Y, and a toner cartridge (not illustrated in detail) that supplies toner to the developing device main body. The toner cartridge is attachable to and detachable from the developing device main body, and can be removed from the developing device main body and replaced if the stored toner runs out.

The exposure device 32 includes a light source (not illustrated) that emits laser light, a plurality of mirrors (not illustrated) that guide the laser light to the photosensitive drums 740Y to 740K, and the like. The transferor 33 includes an intermediate transfer belt 35 that carries toner images formed on the photosensitive drums 740Y to 740K, primary transfer rollers 36Y to 36K that primarily transfer the toner images formed on the photosensitive drums 740Y to 740K onto the intermediate transfer belt 35, a secondary transfer roller 37 that secondarily transfers the toner images transferred onto the intermediate transfer belt 35 onto a sheet, and a belt cleaner 38 that removes toner remaining on the intermediate transfer belt 35. The intermediate transfer belt 35 is wound around a driving roller 39*a* and a driven roller 39*b*, and is pressed against the photosensitive drums 740Y to 740K by the primary transfer rollers 36Y to 36K. The secondary transfer roller 37 and the driving roller 39*a* nip (sandwich) the intermediate transfer belt 35. The secondary transfer roller 37 transfers the toner image carried by the intermediate transfer belt 35 onto a sheet at a nip zone N. The fixer 34 includes a heating roller 34*a* that heats the sheet, and a pressure roller 34*b* in press contact with the heating roller 34*a*.

The operation panel 843 includes a display 845 that displays predetermined information, and an inputter 847 that allows a user to input instructions to the document reading device 820 and the multifunction apparatus main body 830. In the present embodiment, the operation panel 843 is arranged on the front side of the reading device main body 822. It is noted that the front side corresponds to the front side of the drawing sheet of FIG. 16, and the rear side corresponds to the back side of the drawing sheet of FIG. 16.

As illustrated in FIG. 17, the arithmetic processor 841 includes a CPU 841*a* that drives and controls the sheet feeder 10, the manual sheet feeder 20, the image former 30, and the document reading device 820, and a memory 841*b* that stores various programs for operating the CPU 841*a*, various information used by the CPU 841*a*, and the like. The arithmetic processor 841 integrally controls the operations of the sheet feeder 10, the manual sheet feeder 20, the image former 30, and the document reading device 820 based on an operation on the operation panel 843 by the user, to form an image on a sheet.

Next, an image forming operation (image forming control by the arithmetic processor 841) performed by the multifunction apparatus 800 configured as described above will be described. In the present embodiment, an example of image forming operation will be described in which the image former 30 forms an image of a document fed by the automatic document feeder 824 and then read by the reading device main body 822 on a sheet fed by the sheet feeder 10.

When an image formation start signal is transmitted in response to a user input to the inputter 847 of the operation panel 843, a document to be read which is placed on the automatic document feeder 824 by the user is automatically fed toward a document reading position, and the image is read at the document reading position by the reading device main body 822.

Once the image of the document is read by the reading device main body 822, the exposure device 32 emits, to the photosensitive drums 740Y to 740K, the respective laser light beams, based on image information of the read document. At this time, the photosensitive drums 740Y to 740K have been already charged by the chargers 741Y to 741K, respectively, and the laser light each emitted to one of the photosensitive drums 740Y to 740K form electrostatic latent images on the photosensitive drums 740Y to 740K, respectively. Thereafter, the electrostatic latent images formed on the photosensitive drums 740Y to 740K are developed by the developing devices 742Y to 742K to form yellow (Y), magenta (M), cyan (C), and black (K) toner images on the respective photosensitive drums 740Y to 740K The toner images of the respective colors formed on the photosensitive drums 740Y to 740K are superimposed and transferred onto the intermediate transfer belt 35 by the primary transfer rollers 36Y to 36K, and the superimposed and transferred toner image (full color toner image) is conveyed to the nip zone N while being carried on the intermediate transfer belt 35.

In parallel with the image forming operation described above, the sheets stacked on the sheet stacker 11 are fed to a sheet conveyance path 26 by the pickup roller 15 while being separated by the separation feeder 12 one by one. Then, the skew of the sheet is corrected by a pair of registration rollers 27 upstream of the nip zone N in the sheet conveyance direction, and the sheet is conveyed to the nip zone N at a predetermined conveyance timing. Onto the sheet conveyed to the nip zone N, the full color toner image carried by the intermediate transfer belt 35 is transferred by the secondary transfer roller 37.

The sheet onto which the toner image has been transferred is heated and pressed by the fixer 34 to melt and fix the toner image, and is discharged from the device by a pair of discharge rollers 18. The sheet discharged from the device is stacked on a discharge sheet stacker 19.

It is noted that if images are formed. on both sides (a first side and a second side) of a sheet, the pair of discharge rollers 18 is reversely rotated to convey the sheet to a double-sided conveyance path 17 before the sheet of which the first side is formed. with an image is discharged from the device, and then, the sheet is conveyed to the image former 30 via the double-sided conveyance path 17 again. Next, as with the first side, an image is formed on the second side and the sheet is discharged from the device. The sheet discharged from the device is stacked on the discharge sheet stacker 19.

The above-described shading correction signal generation device can be realized by hardware, software, or a combination thereof. Further, the shading correction signal generation method performed by the above-described shading correction signal generation device can also be realized by hardware, software, or a combination thereof. Here, "being realized by software" means being realized by a computer reading and executing a program.

The program may be stored by using various types of non-transitory computer readable media and supplied to a computer. The non-transitory computer readable media include various types of tangible storage media. Examples of the non-transitory computer readable media include magnetic recording media (for example, a flexible disk, a magnetic tape, a hard disk drive), a magneto-optical recording media (for example, a magneto-optical disk), a CD-read only memory (ROM), a compact disc-recordable (CD-R), a compact disc-rewritable (CD-R/W), semiconductor memories (for example, mask ROM, programmable ROM (PROM), erasable PROM (EPROM), flash ROM, random access memory (RAM)). Also, the program may be supplied to the computer by various types of transitory computer readable media. Examples of the transitory computer readable media include electrical signals, optical signals, and electromagnetic waves. The transitory computer readable media can provide the program to the computer via a wired communication line such as an electric wire and an optical fiber, or a wireless communication line.

The present invention can be implemented in various other forms without departing from the spirit or main features thereof. Therefore, the embodiments described above are only examples, and should not be interpreted limitedly. The scope of the present invention is indicated by the claims, and is not restricted by the description of the specification. Further, all modifications and changes belonging to a scope equivalent to the claims are included within the scope of the present invention.

INDUSTRIAL APPLICABILITY

The present invention is capable of using for shading correction.

DESCRIPTION OF REFERENCE NUMERALS

101 Correction amount setting signal generation table
103 Modulator
105 Filter circuit
105A Filter circuit #1
105B Filter circuit #2
107 Laser driver
121 Gain adjuster
123 Analog/digital converter
125 Feedback coefficient device
127 Subtractor
201 Laser emission source

What is claimed is:

1. A shading correction signal generation device for generating a shading correction signal to correct shading, the device comprising:

a correction amount setting signal generator that generates a correction amount setting signal;

a modulator that modulates the correction amount setting signal by a predetermined modulation scheme and outputs the modulation signal; and a filter circuit that filters the modulation signal to generate the shading correction signal, wherein the correction amount setting signal generator generates the correction amount setting signal in which a level of the shading correction signal is a level corresponding to a predetermined period, during the predetermined period, generates the correction amount setting signal in which the level of the shading correction signal changes to correct the shading, during a shading correction period starting after a transition period passes from the predetermined period, and generates the correction amount setting signal in which a difference between a level at an end of the predetermined period and an average level during the transition period is larger than a difference between the level at the end of the predetermined period and a level at a start of the shading correction period, during the transition period.

2. The shading correction signal generation device according to claim 1, wherein the correction amount setting signal generator equalizes a level of the correction amount setting signal during a hold period from an unspecified middle point of the transition period to an end of the transition period, to the level at the start of the shading correction period.

3. The shading correction signal generation device according to claim 2, wherein the correction amount setting signal generator sets a difference between a level of the correction amount setting signal during a change period from a start of the transition period to the unspecified middle point of the transition period and the level of the correction amount setting signal at the end of the predetermined period larger than a difference between the level at the start of the shading correction period and the level of the correction amount setting signal at the end of the predetermined period.

4. A shading correction signal generation device for generating a shading correction signal to correct shading, the device comprising:

a correction amount setting signal generator that generates a correction amount setting signal;

a subtractor that obtains an error signal, based on the correction amount setting signal and a feedback signal;

an adjuster that calculates the error signal by a predetermined gain adjuster to automatically adjust the correction amount setting signal;

a modulator that modulates the automatically adjusted correction amount setting signal by a predetermined modulation scheme and outputs the modulation signal;

a filter circuit that filters the modulation signal to generate the shading correction signal; and a feedback device that obtains the feedback signal from the shading correction signal, wherein the correction amount setting signal generator generates the correction amount setting signal in which a level of the shading correction signal is a level corresponding to a predetermined period, during the predetermined period, generates the correction amount setting signal in which the level of the shading correction signal changes to correct the shading, during a shading correction period starting after a transition period passes from the predetermined period, and generates the automatically adjusted correction amount setting signal in which a difference between a level at an end of the predetermined period and an average level during the transition period is larger than a difference between the level at the end of the predetermined period and a level at a start of the shading correction period, during the transition period.

5. The shading correction signal generation device according to claim 1, wherein the modulator modules the correction amount setting signal by a PDM scheme and outputs the modulation signal.

6. The shading correction signal generation device according to claim 4, wherein the modulator modules the correction amount setting signal by a PDM scheme and outputs the modulation signal.

7. The shading correction signal generation device according to claim 5, wherein a delta-sigma modulation is used for the modulation by the PDM scheme.

8. The shading correction signal generation device according to claim 6, wherein a delta-sigma modulation is used for the modulation by the PDM scheme.

9. The shading correction signal generation device according to claim 1, wherein the filter circuit is a low-pass filter circuit having an order of 2 or more.

10. The shading correction signal generation device according to claim 9, wherein the filter circuit includes a modulator-side low-pass filter circuit arranged at a position within a predetermined distance from the modulator, the modulator-side low-pass filter circuit having an order of 1 or more.

11. The shading correction signal generation device according to claim 9, wherein the filter circuit includes a drive circuit-side low-pass filter circuit arranged at a position within a predetermined distance from an inputter of a drive circuit to which the shading correction signal is supplied, the drive circuit-side low-pass filter circuit having an order of 1 or more.

12. The shading correction signal generation device according to claim 9, wherein the filter circuit includes a configuration where the modulation signal output from the modulator is divided at a position within a predetermined distance from an inputter of a driver that generates a light source drive signal to drive a light source, and is supplied to the driver.

13. A light source drive system device, comprising:

the shading correction signal generation device according to claim 1; and a driver that generates a light source drive signal to drive a light source, based on at least the shading correction signal and an image signal.

14. The light source drive system device according to claim 13, further comprising:

a light receiver that receives light emitted from the light source driven by the light source drive system device; and a synchronization circuit that adjusts a timing of the transition period and the shading correction period, based on a timing at which the light receiver receives light.

15. The light source drive system device according to claim 12, comprising:

an adjust processor that adjusts light emission intensity of the light source for each main scanning period including the predetermined period, the transition period, and the shading correction period, based on intensity of light received by the light receiver, wherein the adjust processor is provided inside or outside the driver.

16. An image forming device comprising the shading correction signal generation device according to claim 1.

* * * * *